US010094079B2

(12) United States Patent
Busley et al.

(10) Patent No.: US 10,094,079 B2
(45) Date of Patent: Oct. 9, 2018

(54) POSITIONING ARRANGEMENT FOR FITTING AN INTERCHANGEABLE MILLING ASSEMBLY OF A ROAD-BUILDING MACHINE

(71) Applicant: Wirtgen GmbH, Windhagen (DE)

(72) Inventors: Peter Busley, Linz/Rhein (DE); Cyrus Barimani, Königswinter (DE); Andreas Salz, Neustadt/Wied (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 15/606,311

(22) Filed: May 26, 2017

(65) Prior Publication Data

US 2017/0284039 A1 Oct. 5, 2017

Related U.S. Application Data

(62) Division of application No. 13/447,708, filed on Apr. 16, 2012.

(30) Foreign Application Priority Data

Apr. 19, 2011 (DE) ..... 10 2011 018 222

(51) Int. Cl.
*E01C 23/08* (2006.01)
*E01C 23/088* (2006.01)

(52) U.S. Cl.
CPC ..... *E01C 23/088* (2013.01)

(58) Field of Classification Search
CPC . B64F 5/00; B64F 5/0036; B62D 7/02; B62D 7/04; B62D 7/14; B62D 7/142; B62D 7/144; B62D 11/20; B23Q 3/157; B25H 1/00; B25H 1/0007; E01C 19/18; E01C 19/42; E01C 23/088; E01C 23/14;
(Continued)

(56) References Cited

U.S. PATENT DOCUMENTS 2,815,566 A 12/1957 Hille
2,974,972 A 3/1961 Hassell
(Continued)

FOREIGN PATENT DOCUMENTS

DE 1288997 B 2/1969
DE 2842173 A1 4/1980
(Continued)

OTHER PUBLICATIONS

European Search Report in corresponding application EP 12002186 dated Aug. 22, 2012, 7 pp (not prior art).

*Primary Examiner* — Saul Rodriguez
*Assistant Examiner* — Brendan P Tighe
(74) *Attorney, Agent, or Firm* — Lucian Wayne Beavers; Patterson Intellectual Property Law, PC

(57) ABSTRACT

The invention relates to a positioning arrangement for fitting an interchangeable milling assembly of a preset working width below the vertically adjustable chassis of a road milling machine, which chassis is carried on track-laying units. A vehicle carried on a plurality of wheels has a unit for receiving the milling assembly. The positioning arrangement has a handling chassis which can be lengthened in the longitudinal direction and to which the wheels are fixed. In a lowered position, the positioning arrangement, with the milling assembly resting on it, can be driven below the chassis of the road milling machine. In a raised position, the milling assembly can be fitted to the road milling machine.

20 Claims, 11 Drawing Sheets

Figure 1A:
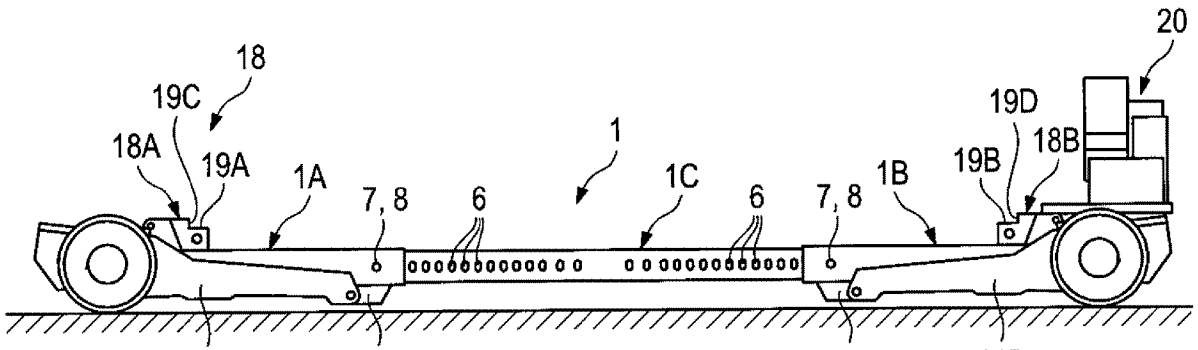

(58) Field of Classification Search
CPC .... E01C 23/18; Y10T 29/49826; B23P 11/00; B60P 1/02; B60P 1/022; B60P 1/025; B60P 1/16; B60P 1/18
USPC ..... 180/9.46, 9.5, 9.52; 414/495, 560, 589, 414/590, 631, 632, 633, 634, 635, 764; 29/428
See application file for complete search history.

(56) References Cited

U.S. PATENT DOCUMENTS

| | | | |
|---|---|---|---|
| 3,268,093 | A | 8/1966 | Keiter |
| 5,083,892 | A | 1/1992 | Oswald et al. |
| 5,605,207 | A | 2/1997 | Betcher et al. |
| 7,721,831 | B2 | 5/2010 | Smolders et al. |
| 2008/0093149 | A1 | 4/2008 | Smolders et al. |

FOREIGN PATENT DOCUMENTS

| | | | |
|---|---|---|---|
| DE | 19612626 | A1 | 10/1997 |
| EP | 1522632 | A1 | 4/2005 |
| EP | 1841637 | A1 | 10/2007 |
| GB | 929322 | A | 6/1963 |
| WO | 2006079652 | A1 | 3/2006 |

POSITIONING ARRANGEMENT FOR FITTING AN INTERCHANGEABLE MILLING ASSEMBLY OF A ROAD-BUILDING MACHINE

BACKGROUND OF THE INVENTION

1. Field of the Invention

The invention relates to a positioning arrangement for fitting an interchangeable milling assembly of a preset working width below the vertically adjustable chassis of a road building machine such as a road milling machine, stabiliser or recycler, which chassis is carried on wheels or track-laying units.

2. Description of the Prior Art

Known road milling machines are used for renovating asphalt or concrete carriageways. To mill away the surface of the carriageway, known road milling machines have a milling assembly which has a milling drum fitted with milling chisels. The milling assembly of known road milling machines is arranged below the chassis of the machine between the front and rear track-laying units which carry the chassis of the machine.

Road milling machines having milling assemblies of different working widths are known. If large milling machines are fitted with milling assemblies whose working width exceeds the permitted width of the machine, special consent is needed for the transport of the road milling machine to the point of use. To avoid the need for such special consent, the milling assembly has to be removed from the large milling machine and transported to the point of use in its longitudinal direction relative to the road, on a low-loader for example. Then, at the point of use, the milling assembly has to be fitted to the large milling machine. This possible procedure is only rarely adopted in practice because the fitting and removal of the milling assembly is time-consuming and labour-intensive due to the large number of steps which the fitting involves and the great weight of the milling assembly. Also, a crane is needed at the point of use. Milling assemblies of a large working width are therefore not very widely accepted in practice.

Known from DE 28 42 173 is a road milling machine which comprises a semi-trailer, carrying a milling drum, which is part of a conventional articulated vehicle. The problem of transporting milling drums of a large working width on public roads is discussed in DE 28 42 173. To solve this problem, what is proposed is that the milling drum be mounted to pivot on the semi-trailer. For it to be transported, the milling drum is pivoted in such a way that it is arranged in the direction of travel of the articulated vehicle. This prevents the milling drum from projecting beyond the sides of the articulated vehicle. However, this prior art is based on a hydraulically driven milling drum which makes a procedure of this kind possible. However, modern-day road milling machines, stabilisers and recyclers have a mechanical drive which does not allow the milling drum to be pivoted. Also, the above solution calls for a considerably longer wheel base, which means a loss of maneuverability for the machine.

SUMMARY OF THE INVENTION

The object underlying the invention is to simplify the use on road milling machines of milling assemblies whose working width is greater than the permitted width for transport of the road milling machine.

The fitting of an interchangeable milling assembly of quite a large working width below the vertically adjustable chassis of a road milling machine is made easier in accordance with the invention by a positioning arrangement which takes the form of a vehicle carried on a plurality of wheels which has a unit for receiving the milling assembly, with at least one wheel being steerable. The positioning arrangement has a handling chassis which can be lengthened in the longitudinal direction and to which the wheels are fixed, to be adjustable vertically relative to the handling chassis, in such a way that the handling chassis can be moved from a position in which it is lowered to a position in which it is raised.

In the lowered position, the positioning arrangement, with the milling assembly resting on it, can be driven under the chassis of the road milling machine. The positioning arrangement having been raised from the lowered position to the raised position, the milling assembly is at the height at which it can be fitted to the road milling machine. The individual steps of the process of fitting the milling assembly of a road milling machine are familiar to the person skilled in the art.

The raising and lowering of the positioning arrangement also allow the milling assembly to be received and set down on a supporting means on which the milling assembly can be parked or suspended at the point of use.

The milling assembly, resting on the positioning arrangement, can be transported to the point of use by a low-loader onto which the positioning arrangement is loaded, together with the milling assembly, in the longitudinal direction. Because the milling assembly can be driven up onto the low-loader and down off the low-loader by the positioning arrangement, there is no need for a crane to be used at the point of use.

In the lowered position, the positioning arrangement is notable for being of a relatively small overall height which makes it easier for it to be driven under the road milling machine. To increase the amount of space available below the chassis of the road milling machine, the chassis of the road milling machine is preferably raised before the positioning arrangement, together with the milling assembly, is driven under the chassis of the machine.

As well as by its relatively low overall height, the positioning arrangement according to the invention is also distinguished by the fact that the handling chassis can be lengthened in the longitudinal direction. This makes it possible for the positioning arrangement to be adjusted to the different working widths of the different milling assemblies, meaning that the length of the handling chassis will exactly correspond to the length of the milling assembly. This keeps the dimensions of the positioning arrangement small, as a result of which the positioning arrangement can be positioned more easily. A particular result of this is tighter turning circles.

In a preferred embodiment of the positioning arrangement according to the invention the wheels are fixed to swinging arms aligned parallel to the direction of travel which are mounted on the longitudinal sides of the handling chassis to be pivotable on a substantially horizontally arranged axis of rotation extending transversely to the direction of travel. Swinging arms which are at the front and swinging arms which are at the rear in the longitudinal direction of the handling chassis are preferably pivotably fixed to respective ones of the two sides of the handling chassis. This way of suspending the wheels makes it possible for the positioning arrangement to be of a relatively low overall height while there is a relatively long travel between the raised and lowered positions. The swinging arms also make it easier for the positioning arrangement to be transported on a low-loader because the positioning arrangement, which is lashed to the load-carrying surface of the low-loader together with the milling assembly resting on it, can be supported on the swinging arms. This makes for better stability during transport. The swinging arms themselves may for example rest on profiled lengths of wood or the like, which can easily be slid under the swinging arms as a result of the vertical adjustment.

What are provided to pivot the swinging arms are preferably piston and cylinder arrangements which on the one hand are connected by joints to the handling chassis and on the other hand are connected by joints to the swinging arms. The handling chassis is adjusted in the vertical direction by extending and retracting the piston and cylinder arrangements. The piston and cylinder arrangements are preferably fixed to the handling chassis in such a way that that they do not extend beyond the unit for receiving the milling assembly to any substantial extent in the vertical direction. This keeps the overall height of the positioning arrangement small.

Swinging arms which are at the front and rear in the longitudinal direction of the handling chassis are preferably fixed to each of the two sides of the handling chassis to be pivotable. The front swinging arms and/or the rear swinging arms may also be connected together by means of transverse profiles.

Another preferred embodiment makes provision for the chassis of the machine to have two outer main frames and one inner frame. The two outer main frames and the inner frame are guided to be displaceable relative to one another to allow the length of the handling chassis to be adjusted in the longitudinal direction of the said handling chassis. This gives a relatively simple structure of relatively high strength. The chassis of the machine may however equally well comprise only two parts which are guided to be longitudinally displaceable relative to one another.

In an embodiment which is a particular preference, the outer main frames have hollow profiles and the inner frame has beams, with the beams of the inner frame being guided to be longitudinally displaceable in the hollow profiles of the main frames. It is however also possible for the main frames to have beams and for the inner frame to have hollow profiles to receive the beams of the main frames in such a way such they are longitudinally displaceable.

The receiving unit preferably has a receptacle for the front region of the milling assembly which is at the front in the longitudinal direction of the handling chassis and a receptacle for the rear region of the milling assembly which is at the rear in the longitudinal direction of the handling chassis. Consequently, the milling assembly rests down only at the front and rear ends of the positioning arrangement. Corresponding receptacles by which the milling assembly can be safely loaded onto the positioning arrangement are preferably provided on the milling assembly.

The wheels are preferably fixed to the handling chassis in such a way that they extend to only an insignificant degree beyond the unit for receiving the milling assembly in the vertical direction when the handling chassis is in the lowered position. This keeps the overall height of the positioning arrangement small.

In a preferred embodiment the drive unit, which takes up a good deal of space and which may comprise a plurality of sub-assemblies such for example as a drive engine, hydraulic pumps, etc., is arranged at one end of the handling chassis. What is achieved in this way is that the positioning arrangement is still of a small overall height in the region of the receiving unit to allow it to be driven under the chassis of the road milling machine. The drive unit is then situated in front of or behind the milling assembly resting on the receiving unit, on one or other side of the chassis of the road milling machine.

The positioning arrangement according to the invention preferably has steering on all its wheels, i.e. preferably on all its four wheels, which allows positioning within a tight range. The steerable angle, preferably at all the wheels, is preferably 90°, which means that the positioning arrangement, with the milling assembly loaded on it, can be positioned satisfactorily under the milling machine. Steering arrangements having a large steering angle are known from the present applicant's EP 1 522 632 B1 and EP 1 841 637 B1.

In what follows, an embodiment of the invention is explained in detail by reference to the drawings.

Figure 1B:
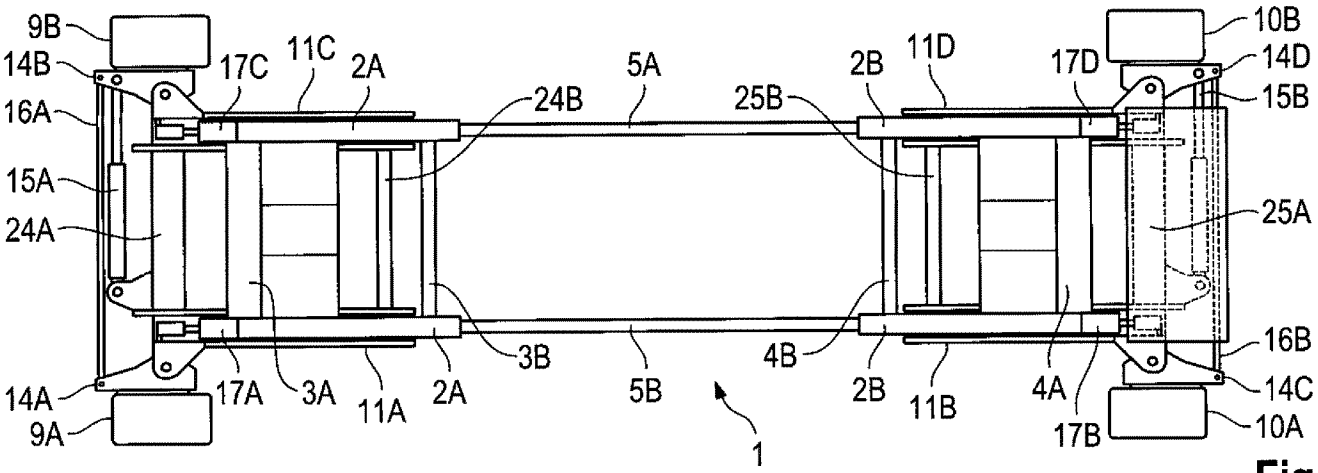
Figure 2A:
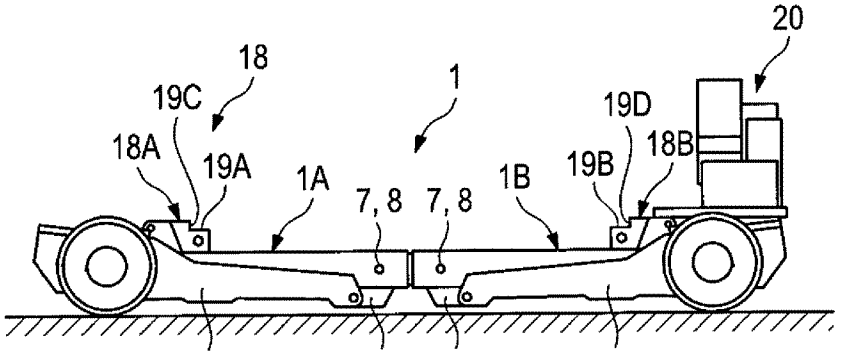
Figure 2B:
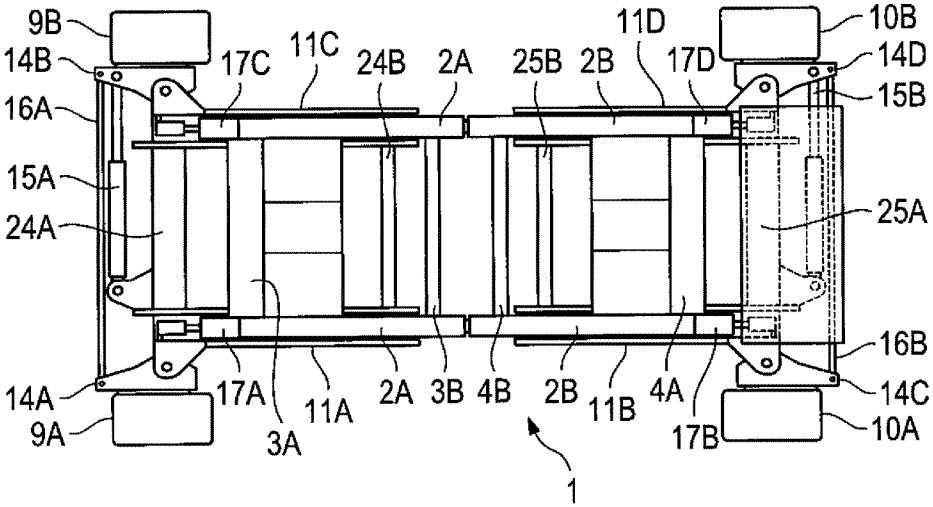
Figure 3A:
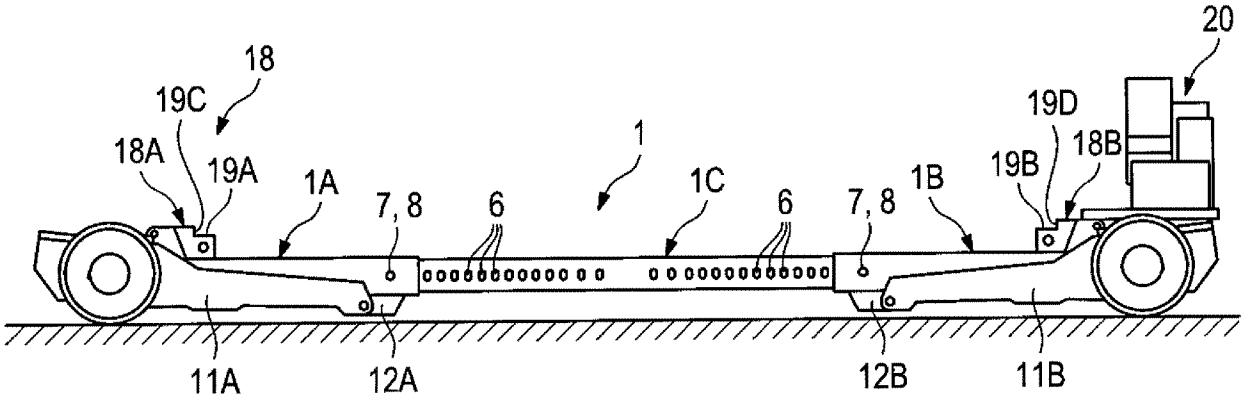
Figure 3B:
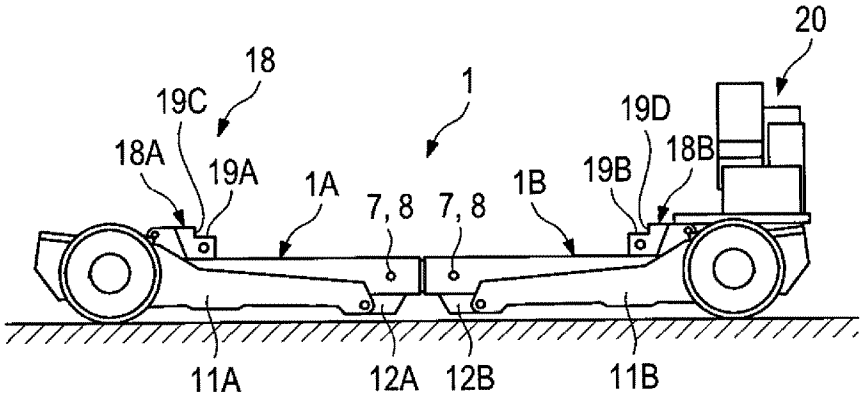
Figure 4A:
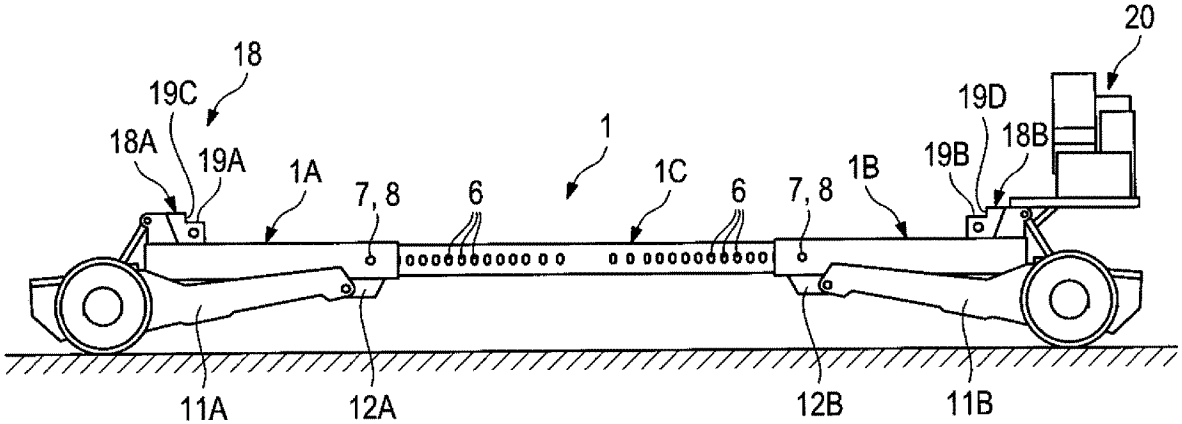
Figure 4B:
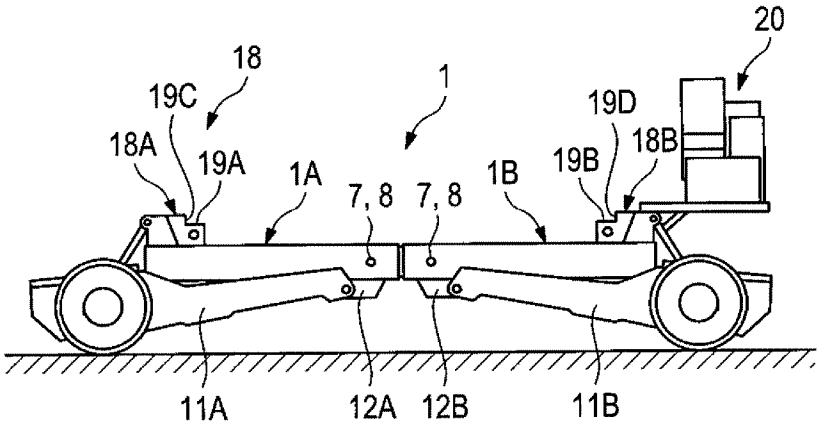
Figure 5:
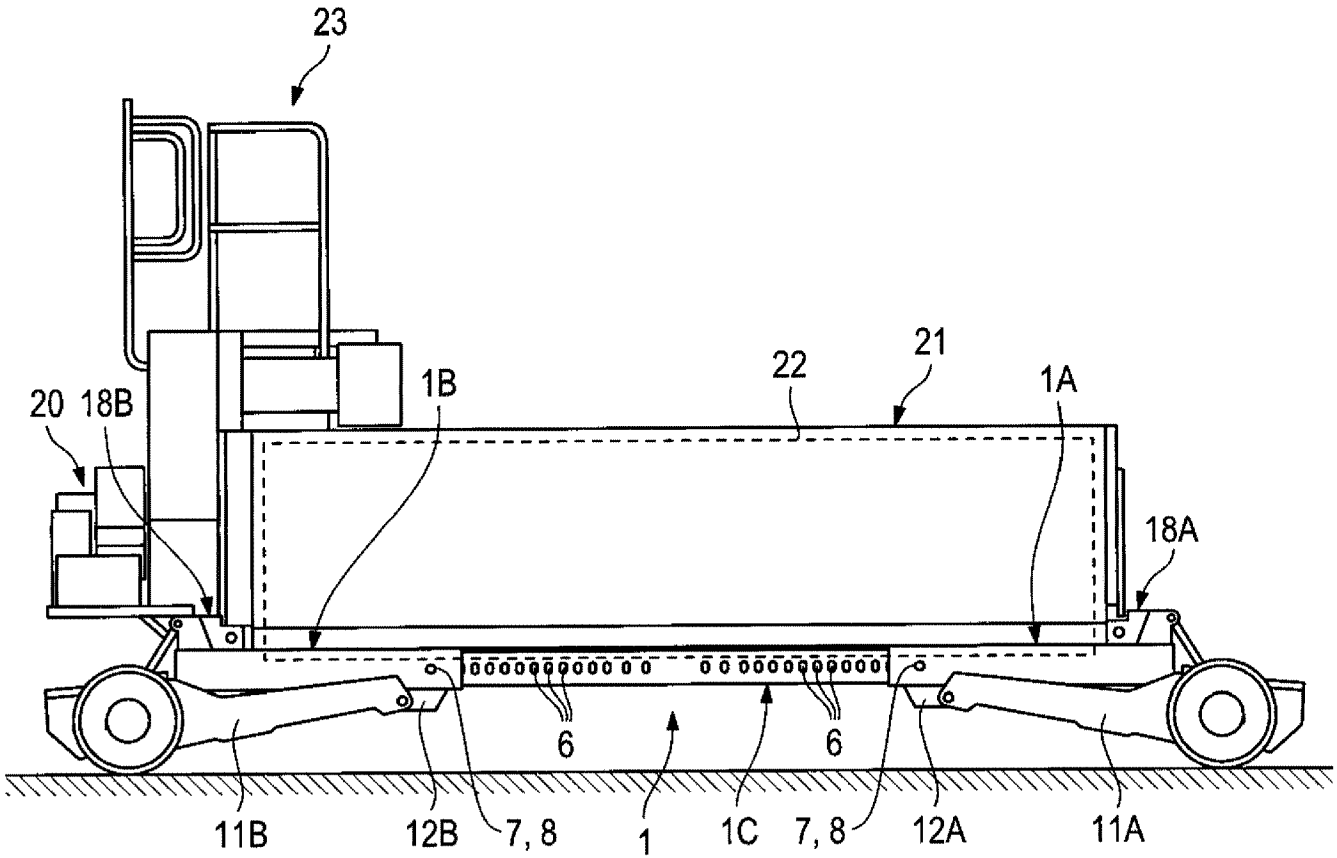
Figure 6:
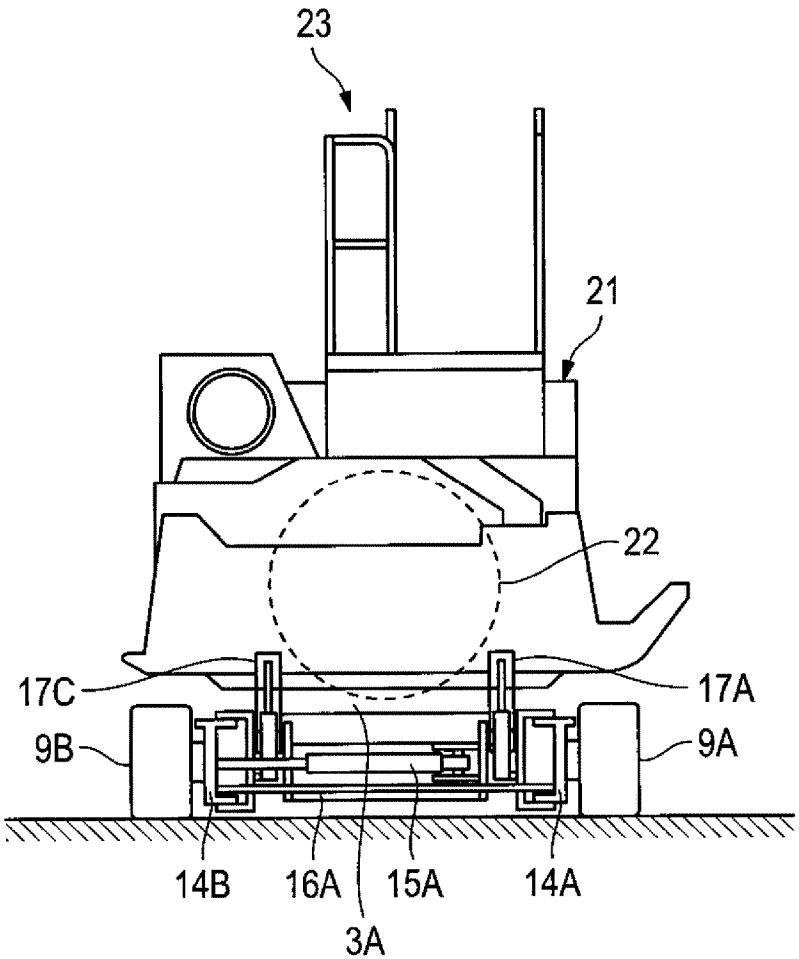
Figure 7A:
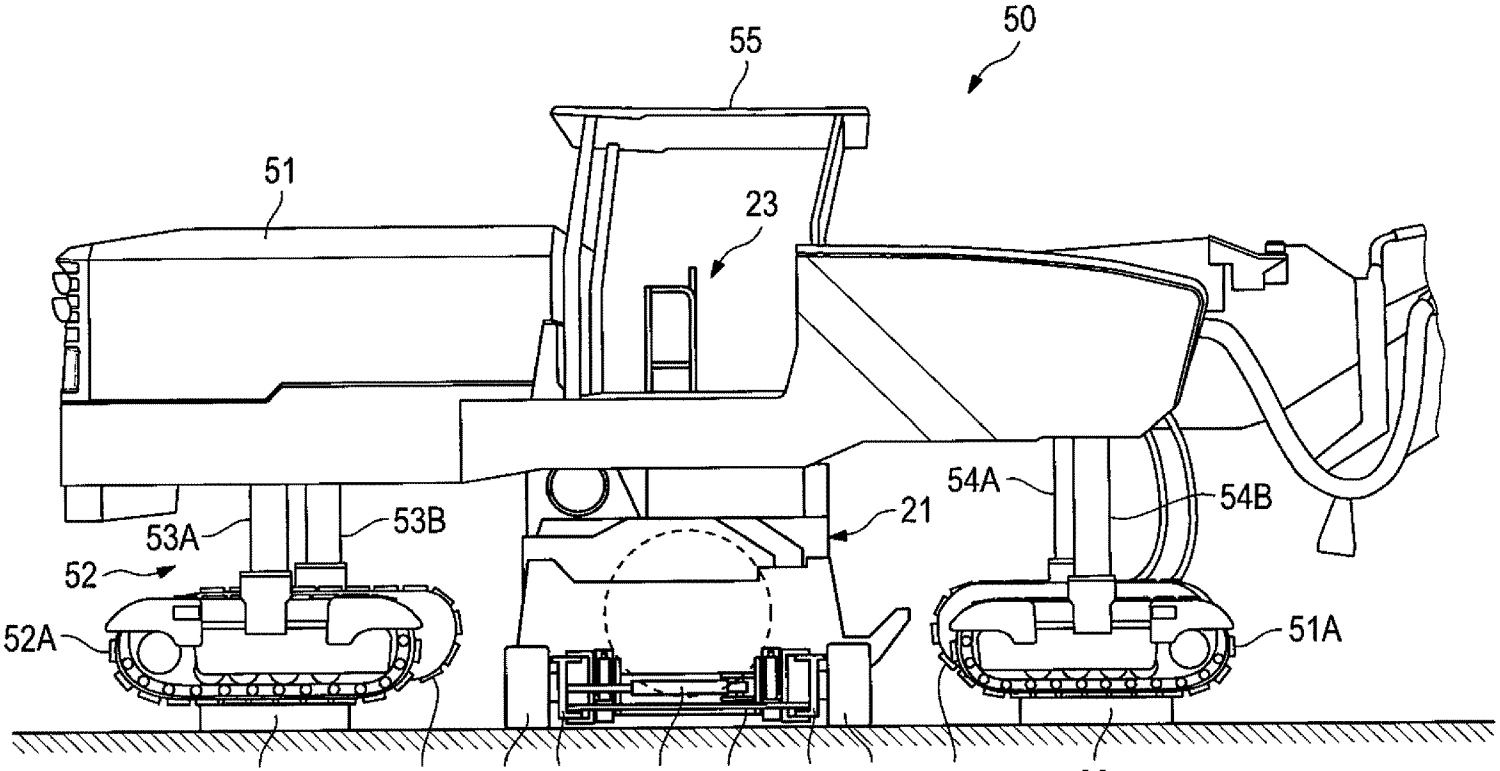
Figure 7B:
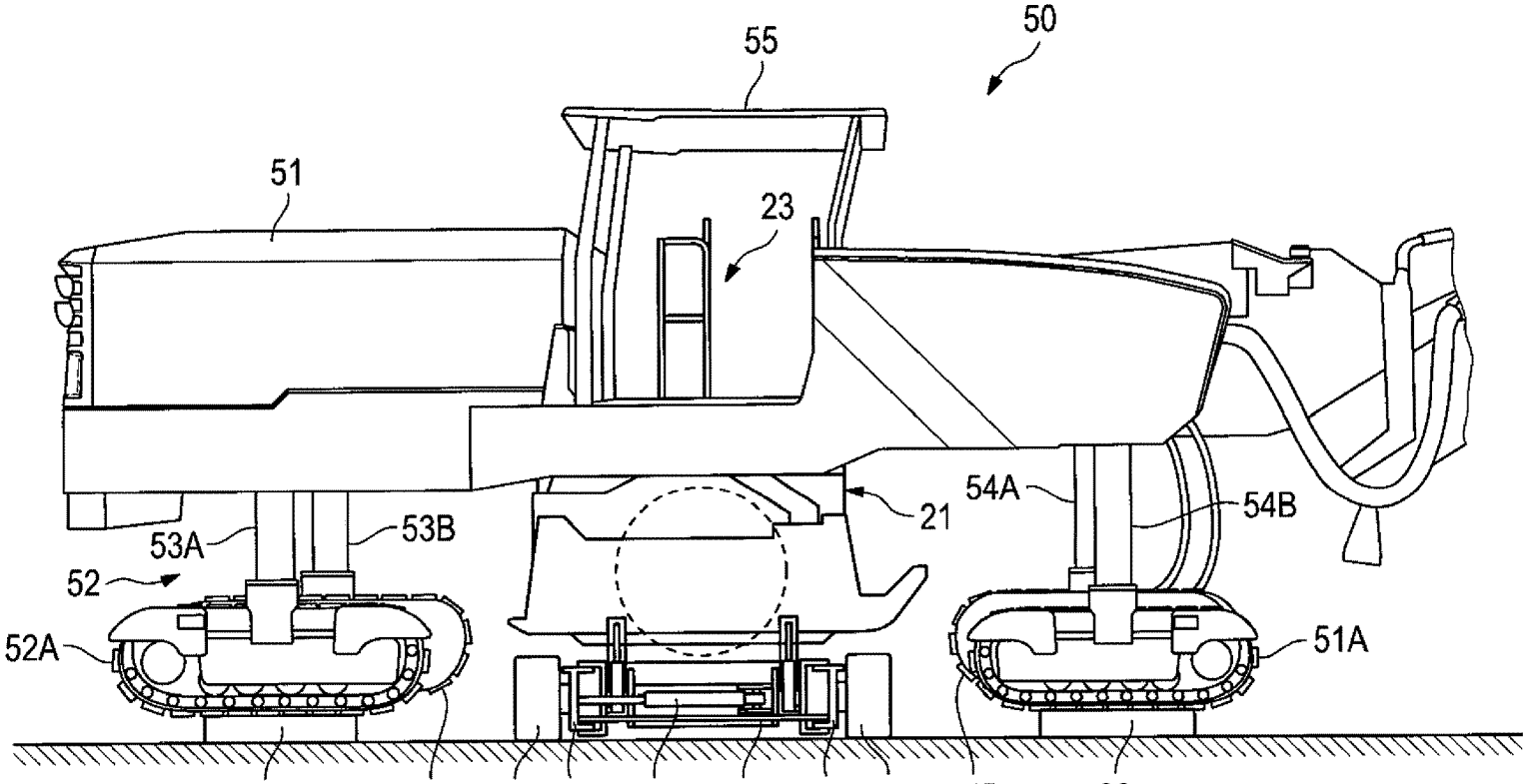
Figure 7C:
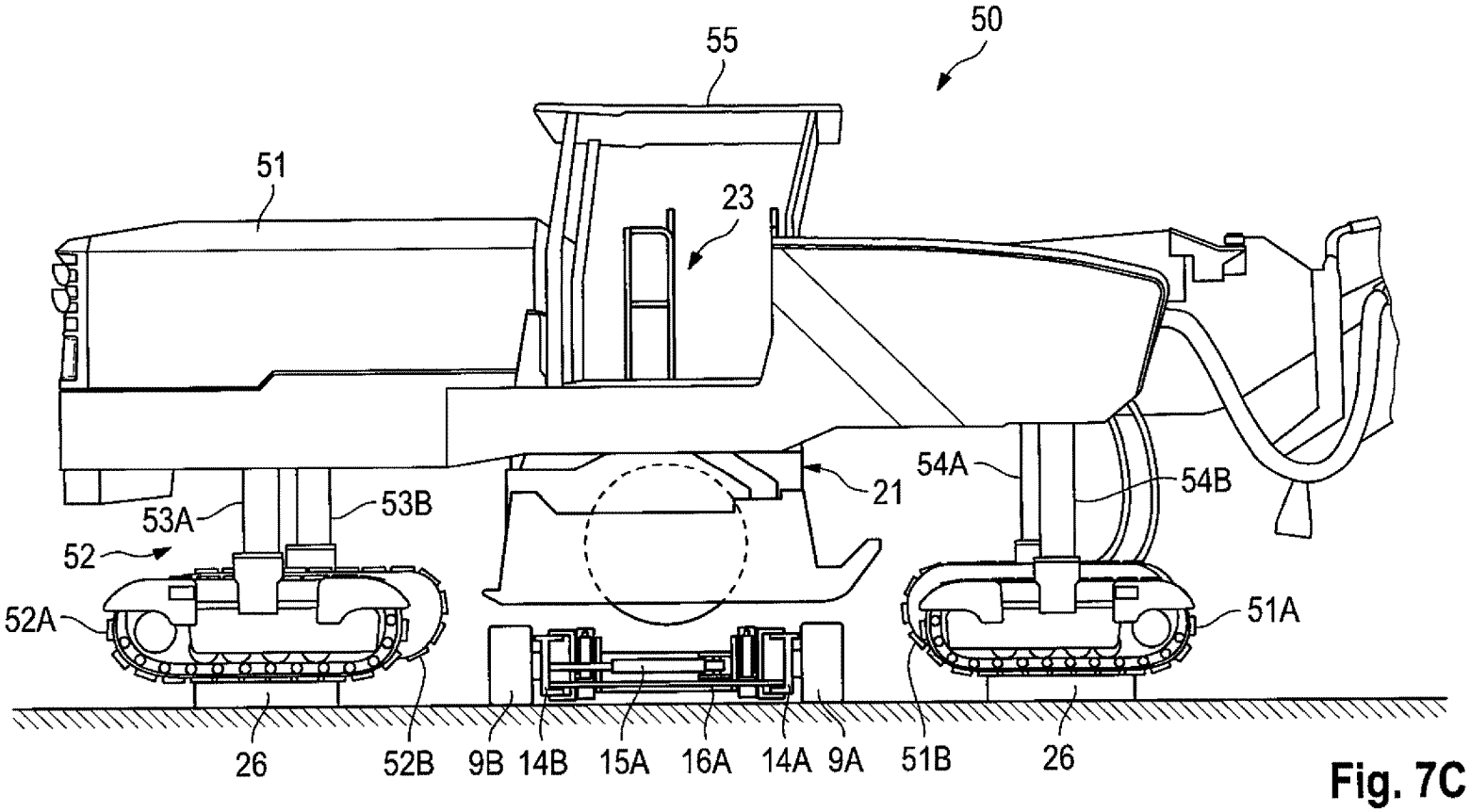
Figure 7D:
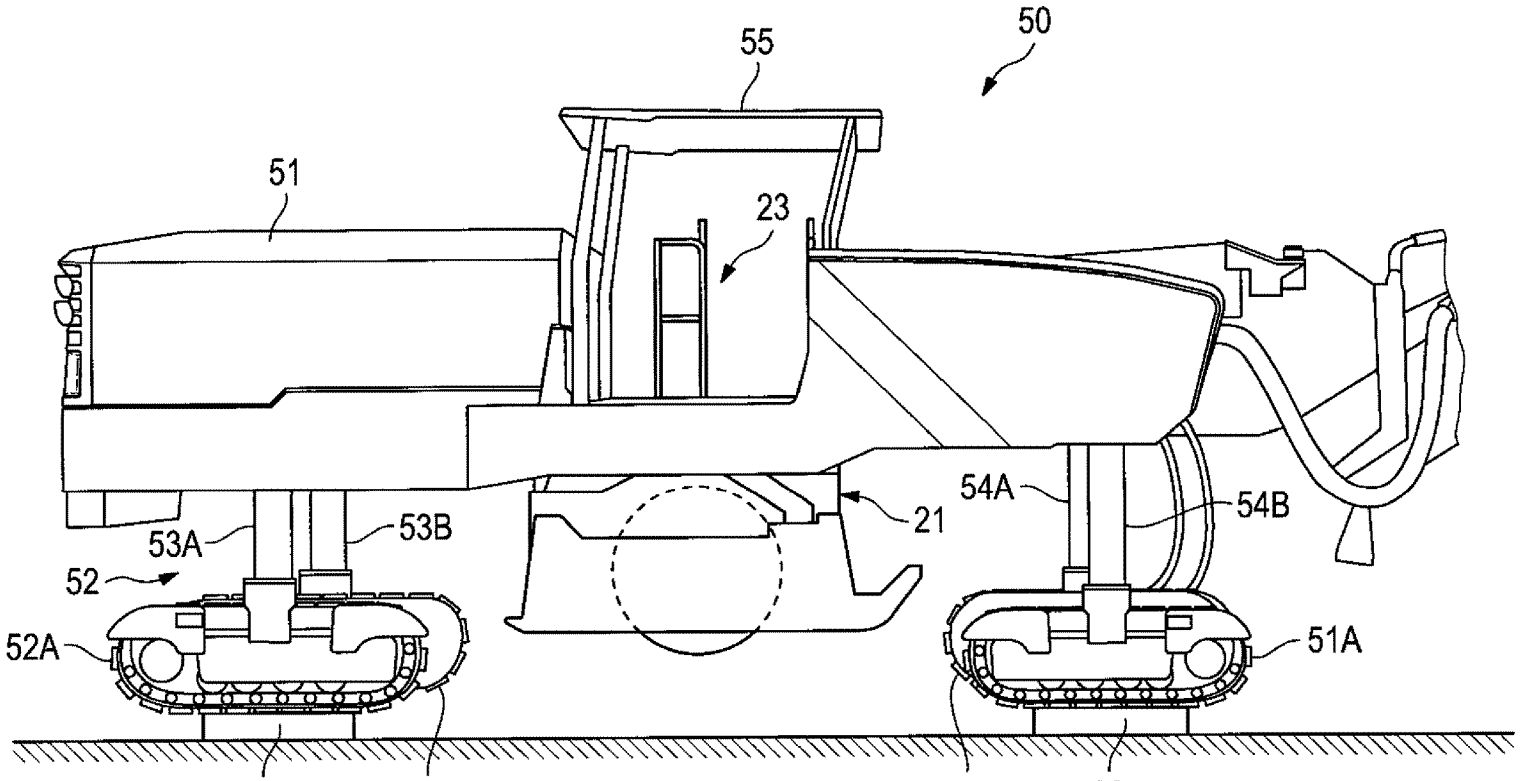
Figure 7E:
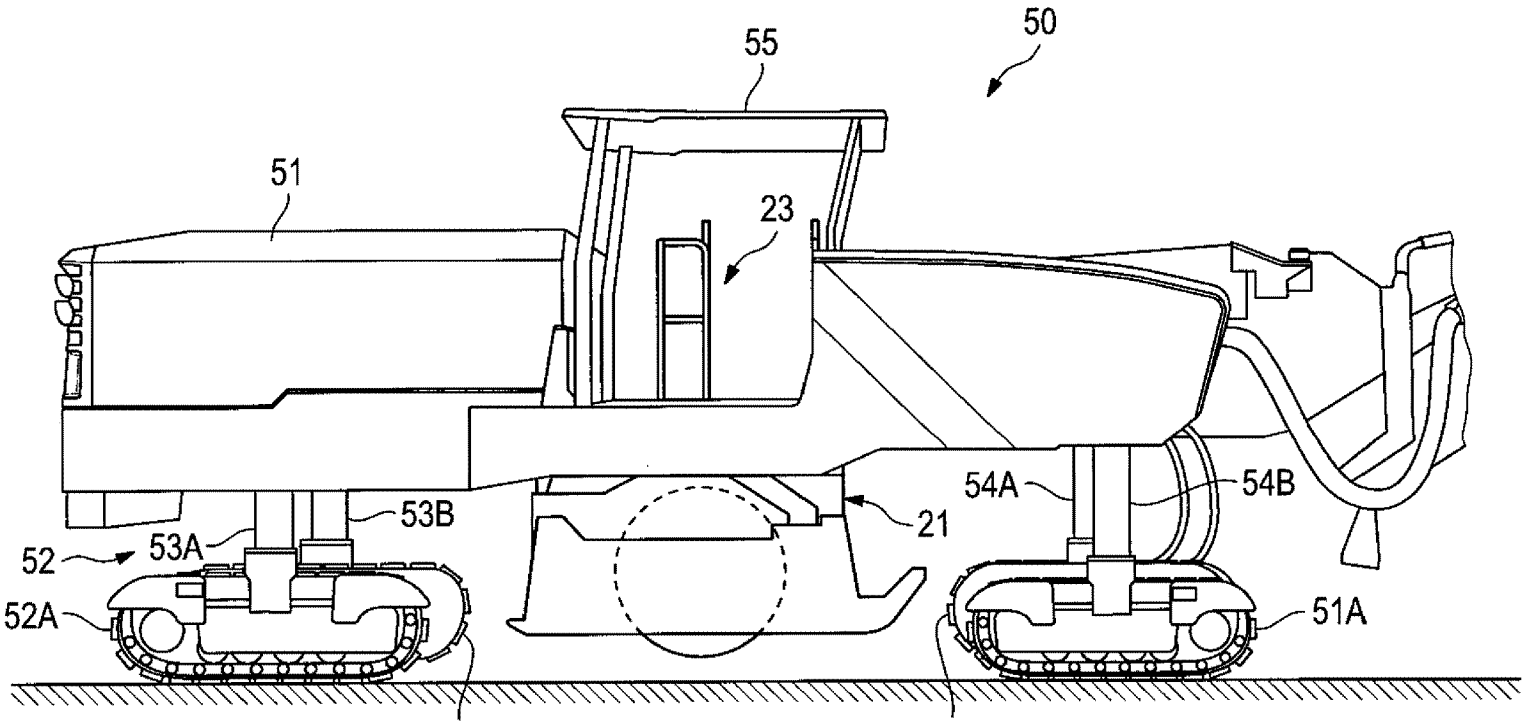

In the drawings:

FIG. 1A is a view from the side of the positioning arrangement in the lowered position, with the handling chassis extended to its maximum length, FIG. 1B is a plan view of the positioning arrangement shown in FIG. 1A, FIG. 2A is a view from the side of the positioning arrangement, with the handling chassis lowered and closed up to its minimum length for handling duties, FIG. 2B is a plan view of the positioning arrangement shown in FIG. 2A, FIG. 3A is a view from the side of the positioning arrangement in the lowered positioning position, with the handling chassis extended, FIG. 3B is a view from the side of the positioning arrangement in the lowered positioning position, with the handling chassis closed up, FIG. 4A shows the positioning arrangement shown in FIG. 3A in the raised fitting position, FIG. 4B shows the positioning arrangement shown in FIG. 3B in the raised fitting position, FIG. 5 is a view from the side of the positioning arrangement in the fitting position, with the handling chassis extended and with the milling assembly of a road milling machine resting on the receiving unit of the positioning arrangement, FIG. 6 is a view from the front of the positioning arrangement together with the milling assembly shown in FIG. 5, FIG. 7A is a view from the side of the road milling machine together with the positioning arrangement on which the milling assembly is resting, the handling chassis of the positioning arrangement being in the positioning position, FIG. 7B shows the road milling machine together with the positioning arrangement shown in FIG. 7A, the handling chassis being in the fitting position, FIG. 7C shows the road milling machine shown in FIG. 7A together with the positioning arrangement, the milling assembly having been fitted to the milling machine and the handling chassis of the positioning arrangement having been lowered, FIG. 7D shows the road milling machine shown in FIG. 7A with the milling assembly fitted, the positioning arrangement having been driven away, FIG. 7E shows the road milling machine shown in FIG. 7D, the chassis of the road milling machine having been lowered.

DETAILED DESCRIPTION

FIGS. 1A and 1B to 4A and 4B are views from the side and plan views of the positioning arrangement in its different operating positions. The positioning arrangement takes the form of a vehicle carried on a plurality of wheels which has a receiving unit for milling assemblies of different working widths which are not shown in FIGS. 1A, 1B to 4A, 4B.

The positioning arrangement is a self-propelled arrangement. It has an elongated handling chassis 1 which can be lengthened in the longitudinal direction. In FIGS. 1A and 1B the handling chassis 1 is shown in the position where it is extended to its maximum length whereas FIGS. 2A and 2B show the handling chassis in the position where it is closed up to its minimum length. The handling chassis can however also be extended to set lengths which are between these two positions. The length of the handling chassis can thus be set exactly to the working width of the milling assembly which is to be fitted.

Although the positioning arrangement is so designed that it does not, in principle, have any preferred direction of travel, the end of the positioning arrangement which is on the left in the drawings will be referred to as the front end and the end which is on the right will be referred to as the rear end.

The handling chassis 1 of the positioning arrangement comprises two outer main frames 1A and 1B and an inner frame 1C situated between them. The front main frame 1A and rear main frame 1B have respective lateral hollow profiles 2A and 2B extending in the longitudinal direction of the handling chassis 1 which are connected to transversely extending profiles 3A, 3B and 4A, 4B. The inner frame 1C has two lateral beams 5A, 5B extending in the longitudinal direction which are guided to be longitudinally displaceable in the hollow profiles 2A, 2B of the outer main frames 1A and 1B. Consequently, the handling chassis 1 can have its length lengthened or shortened telescopically. The beams 5A, 5B of the inner frame 1C have a row of holes 6 which can be lined up with holes 7 in the hollow profiles 2A, 2B of the main frames 1A, 1B. The main frames 1A, 1B and the inner frame 1C are secured against displacement by means of pins 8 which are fitted in the lined-up holes 6, 7 in the main and inner frames.

The positioning arrangement has two front wheels 9A, 9B and two rear wheels 10A, 10B. The wheels 9A, 9B and 10A, 10B are fixed to swinging arms 11A to 11D aligned parallel to the longitudinal direction of the handling chassis 1 which are mounted on the longitudinal sides of the handling chassis to be able to pivot on a substantially horizontal axis of rotation extending transversely to the direction of travel. The swinging arms 11A and 11C on the front main frame 1A and the swinging arms 11B and 11D on the rear main frame 1B are connected together by transversely extending profiles 24A and 24B, and 25A and 25B, respectively. One end of each swinging arm 11A to 11D is fixed to be pivotable to a bracket 12A, 12B which is fixed to the underside of a hollow profile 2A, 2B of a main frame 1A, 1B. The wheels 9A, 9B, 10A, 10B are pivotably mounted on the other ends of the swinging arms 11A to 11D.

The front and rear steering systems comprise front and rear wheel brackets 14A, 14B and 14C, 14D respectively and front and rear piston and cylinder arrangements 15A and 15B respectively plus front and rear track rods 16A and 16B respectively. By the extension or retraction of the piston rods of the front and rear piston and cylinder arrangements 15A and 15B, the front and rear wheels 9A, 9B and 10A, 10B can be steered. The range within which the positioning arrangement can perform its positioning is thus a tight one, particularly when the main and inner frames are slid together.

The lateral swinging arms 11A to 11D of the suspension system for the wheels allow the handling chassis 1 of the positioning arrangement to be raised from a lowered position to a raised position or to be lowered. In what follows, the lowered position will be referred to as the positioning position and the raised position as the fitting position in view of the direct use made of them at the time of fitting or removal. It may also be necessary for the raised or lowered position to be used or for a change to be made between these positions when the positioning arrangement is being converted, loaded or transported.

The front swinging arms 11A, 11C have front piston and cylinder arrangements 17A, 17C associated with them and the rear swinging arms 11B, 11D have rear piston and cylinder arrangements 17B, 17D associated with them, which piston and cylinder arrangements each extend in the longitudinal direction of the handling chassis above the hollow profiles forming the main beams. The cylinders of the piston and cylinder arrangements 17A to 17D are fixed, to be pivotable, to the free ends of the swinging arms 11A to 11D and the piston rods of the piston and cylinder arrangements 17A to 17D are fixed, to be pivotable, to the inner ends of the hollow profiles of the main frames 1A, 1B. By retracting or extending the piston and cylinder arrangements associated with the swinging arms, the handling chassis can be moved between the lowered positioning position and the raised fitting position. FIGS. 3A and 3B show the positioning arrangement in the positioning position whereas FIGS. 4A and 4B show it in the fitting position. In the positioning position, the positioning arrangement is notable for its particularly low overall height.

The receiving unit 18 of the positioning arrangement for receiving the milling assembly has a front receptacle 18A which is arranged at the outer end of the front main frame and a rear receptacle 18B which is arranged at the outer end of the rear main frame. These two receptacles 18A, 18B are situated as low as is possible on the main frames 1A, 1B. They each have a supporting surface 19A, 19B and a shoulder 19C, 19D in the form of a step, thus enabling the front and rear ends of the milling assembly to be inserted in the receptacles or supports.

It is crucial for the overall height of the positioning arrangement to be as small as possible. The wheels 9A, 9B and 10A, 10B are therefore fixed to the swinging arms 11A to 11D in such a way that in the positioning position the tops of the wheels are substantially on a level with the receiving unit 18. The piston and cylinder arrangements 17A to 17D for pivoting the swinging arms 11A to 11D are also fixed to the handling chassis in such a way that they do not extend beyond the receiving unit 18 in the vertical direction. The receiving unit 18 is therefore substantially on a level with the wheels or lower.

In the present embodiment, the wheels 9A, 9B and 10A, 10B are driven by hydraulic motors built into the hubs of the wheels, which motors are not shown in the drawings. The unit for supplying the hydraulic motors and the piston and cylinder units with hydraulic oil will be referred to below as the control and driving unit 20. The control and driving unit 20, which may comprise a plurality of sub-assemblies, is arranged at the rear end of the rear main frame 1B behind the rear receptacle 18B of the receiving unit 18. Because it is only its height in the region of the receiving unit 18 which is important when the positioning arrangement is used to drive under the milling machine, these sub-assemblies may extend beyond the receiving unit in the vertical direction.

The individual steps of the method by which an interchangeable milling assembly is fitted to a road milling machine using the positioning arrangement according to the invention will be described in detail below by reference to FIGS. 5 to 7E.

FIG. 5 shows the positioning arrangement together with a known milling assembly for a known road milling machine. The milling assembly 21 has a milling drum 22 which is merely indicated and whose working width is for example 4 m. As well as the milling drum 22, the milling assembly 21 also has other components 23 which are merely indicated. These components are situated at one end of the milling drum 21.

For the milling assembly 21 to be handled, the handling chassis 1 of the present embodiment of positioning arrangement is extended to its maximum length. The milling assembly 21 is loaded onto the positioning arrangement in such a way that it rests by its front and rear ends on the front and rear supporting surfaces 19A, 19B of the front and rear receptacles 18A, 18B of the receiving unit 18, between the shoulders 19A, 19B in the form of steps.

The positioning arrangement, together with the milling assembly, can be loaded onto a low-loader. A crucial advantage of the positioning arrangement is that, via a loading ramp, the milling assembly can be driven up onto the low-loader or off the low-loader by the positioning arrangement under the latter's own power without a crane being required at the point of use.

FIG. 6 is a view from the front of the milling assembly 21, resting on the receiving unit 18 of the positioning arrangement, on its way to the road milling machine to which the said milling assembly is going to be fitted. For reasons of clarity, the drive unit 20 of the positioning arrangement is not shown in FIG. 6. FIGS. 7A to 7E show the individual steps of the process of fitting the milling assembly to the road milling machine. The drive unit is not shown in FIG. 7A to FIG. 7C either.

The road milling machine is a known road milling machine 50 which has a chassis 51 and running gear 52. The running gear 52 comprises two front track-laying units 51A and 51B and two rear track-laying units 52A and 52B which are arranged on the two sides of the chassis 51 of the machine at the front and rear ends. The chassis 51 of the machine and the running gear 52 are connected together by means of the piston and cylinder units 53A, 53B, 54A, 54B associated with the track-laying units 51A, 51B, 52A, 52B in such a way that the chassis 51 of the machine can be raised and lowered in the vertical direction relative to the ground. The driver's position 55 on the milling machine is situated on the chassis 51 of the machine between the front and rear track-laying units 51A, 51B and 52A, 52B. Situated below the driver's position 55, on the chassis 51 of the machine, is the interchangeable milling assembly 21. When the milling assembly 21 is of a large working width, such as 4 m for example, the said milling assembly extends beyond the chassis of the machine laterally.

The milling assembly 21 is fitted to the underside of the chassis 51 of the machine. The individual steps of the process of fixing the milling assembly to the road milling machine mechanically and of connecting the milling assembly to the road milling machine electrically and/or hydraulically are familiar to the person skilled in the art. The milling assembly may for example be bolted to the chassis of the machine.

To fit the milling assembly, the cylinder arrangements 53A, 53B and 54A, 54B of the road milling machine which are associated with the track-laying units 51A, 51B and 52A, 52B are extended and the chassis 51 of the machine is thus raised to its maximum working height. In this position there is enough space for the positioning arrangement, with the milling assembly resting on it, to be driven under the chassis 51 of the machine.

The positioning arrangement, together with the milling assembly, is driven under the chassis of the milling machine, transversely to the direction of operation of the machine, so that the fixing points (not shown) on the milling assembly and the chassis of the machine are in line with one another. While the positioning arrangement, together with the milling assembly, is being driven under the chassis of the machine, the handling chassis 1 of the positioning arrangement is in the lowered positioning position and there is thus enough space available under the chassis of the machine. Should there not be enough space under the chassis of the machine even with the low overall height of the positioning arrangement, it is possible for the space available under the machine to be increased by placing planks 26 or the like underneath the running gear of the milling machine (FIG. 7A).

The handling chassis 1 of the positioning arrangement is then raised to the fitting position by extending the piston and cylinder arrangements 17A to 17D. When this is done, the milling assembly 21 is moved to a height at which the fixing points on the milling assembly are resting against the fixing points on the chassis of the machine. The actual fitting of the milling assembly can then take place (FIG. 7B).

The milling assembly 21 having been fixed to the chassis 51 of the road milling machine, by means of bolts (not shown) for example, and the other components which are not shown having been connected up, the handling chassis 1 of the positioning arrangement is lowered again (FIG. 7C) and the positioning arrangement is driven away (FIG. 7D).

The piston and cylinder arrangements 53A, 53B and 54A, 54B associated with the track-laying units are then retracted and the chassis 51 of the road milling machine thus sinks down and the road milling machine is driven down off the planks 26 or the like (FIG. 7E). The road milling machine is now ready for use.

The individual steps of the method of removing the milling assembly correspond to the steps of fitting it. The individual steps are however performed in the reverse order.

The milling assembly can be received on the positioning arrangement and driven onto the low-loader. The positioning arrangement can also be used to park the milling assembly at the point of use. For this purpose, a supporting frame may be provided at the point of use, on which the milling assembly can be parked or suspended by raising and lowering the handling chassis, without a crane being required at the point of use. The supporting frame may be so designed as to be able to take a plurality of milling assemblies of different working widths which can easily be fitted to and removed from the road milling machine by using the handling arrangement.

What is claimed is:

1. A method of fitting a milling assembly below a machine chassis of a road building machine, the machine chassis carried on wheels or track-laying units, using a positioning arrangement, the method comprising:

(a) driving the positioning arrangement, with the milling assembly resting on the positioning arrangement and when in a lowered position, under the machine chassis of the road building machine such that a longitudinal direction of a handling chassis of the positioning arrangement extends transversely to a longitudinal direction of the road building machine;

(b) raising the positioning arrangement from the lowered position to a raised position;

(c) fitting the milling assembly to the road building machine; and (d) lowering the positioning arrangement from the raised position and driving the positioning arrangement away without the milling assembly resting on the positioning arrangement.

2. The method according to claim 1, wherein step (a) further comprises:

driving the positioning arrangement such that a highest point of the positioning arrangement does not pass under the machine chassis of the road building machine; and resting the milling assembly on the positioning arrangement such that components of the milling assembly forming a highest point of the milling assembly are adjacent the highest point of the positioning arrangement.

3. The method according to claim 1, wherein step (a) further comprises:

driving the positioning arrangement such that a highest point of the positioning arrangement does not pass under the machine chassis of the road building machine; and resting the milling assembly on the positioning arrangement such that components of the milling assembly forming a highest point of the milling assembly also do not pass under the machine chassis of the road building machine.

4. The method according to claim 1, further comprising:

raising the machine chassis of the road building machine before driving the positioning arrangement under the machine chassis.

5. The method according to claim 4, wherein:

the step of raising the machine chassis further includes extending piston and cylinder arrangements of the road building machine, thereby raising the machine chassis of the road building machine.

6. The method of claim 5, wherein:

the step of raising the machine chassis further includes raising the machine chassis of the road building machine to a maximum height.

7. The method of claim 4, further comprising:

placing one or more supports under the wheels or track-laying units of the road building machine.

8. The method of claim 1, further comprising:

unloading the positioning arrangement, with the milling assembly resting on the positioning arrangement, off of a low-loader prior to step (a).

9. The method according to claim 1, wherein:

step (b) further includes extending at least one piston and cylinder arrangement of the positioning arrangement; and step (d) further includes retracting the at least one piston and cylinder arrangement of the positioning arrangement.

10. The method according to claim 1, further comprising:

lowering the machine chassis of the road building machine after step (d).

11. A method of removing a milling assembly from below a machine chassis of a road building machine, the machine chassis carried on wheels or track-laying units, using a positioning arrangement, the method comprising:

(a) driving the positioning arrangement, without the milling assembly resting on the positioning arrangement and when in a lowered position, under the machine chassis of the road building machine such that a longitudinal direction of a handling chassis of the positioning arrangement extends transversely to a longitudinal direction of the road building machine;

(b) raising the positioning arrangement from the lowered position to a raised position;

(c) removing the milling assembly from the road milling machine; and (d) lowering the positioning arrangement from the raised position and driving the positioning arrangement away with the milling assembly resting on the positioning arrangement.

12. The method according to claim 11, wherein:

step (a) further comprises driving the positioning arrangement such that a highest point of the positioning arrangement does not pass under the machine chassis of the road building machine; and step (d) further comprises resting the milling assembly on the positioning arrangement such that components of the milling assembly forming a highest point of the milling assembly are adjacent the highest point of the positioning arrangement.

13. The method according to claim 11, wherein:

step (a) further comprises driving the positioning arrangement such that a highest point of the positioning arrangement does not pass under the machine chassis of the road building machine; and step (d) further comprises:

driving the positioning arrangement away such that the highest point of the positioning arrangement does not pass under the machine chassis of the road building machine; and resting the milling assembly on the positioning arrangement such that components of the milling assembly forming a highest point of the milling assembly also do not pass under the machine chassis of the road building machine.

14. The method according to claim 11, further comprising:

loading the positioning arrangement, with the milling assembly resting on the positioning arrangement, onto a low-loader.

15. The method according to claim 11, further comprising:

raising the machine chassis of the road building machine before driving the positioning arrangement under the machine chassis.

16. The method according to claim 15, wherein:

the step of raising the machine chassis further includes extending piston and cylinder arrangements of the road building machine, thereby raising the machine chassis of the road building machine.

17. The method of claim 16, wherein:

the step of raising the machine chassis further includes raising the machine chassis of the road building machine to a maximum height.

18. The method of claim 15, further comprising:

placing one or more supports under the wheels or track-laying units of the road building machine.

19. The method according to claim 11, wherein:

step (b) further includes extending at least one piston and cylinder arrangement of the positioning arrangement; and step (d) further includes retracting the at least one piston and cylinder arrangement of the positioning arrangement.

20. The method according to claim 11, further comprising:

adjusting a length of the positioning arrangement such that the positioning arrangement is configured to receive the milling assembly.

* * * * *